United States Patent [19]

Plumadore

[11] Patent Number: 4,595,276

[45] Date of Patent: Jun. 17, 1986

[54] INCLINED TONER FLOW CONTROL SYSTEM FOR DEVELOPING AN ELECTROSTATIC LATENT IMAGE UPON A ROLL CASSETTE, APERTURE CARD, OR MICROFICHE TYPE ELECTROPHOTOGRAPHIC FILM ELEMENT

[75] Inventor: John D. Plumadore, Westfield, Mass.

[73] Assignee: Photon Chroma, Inc., Westfield, Mass.

[21] Appl. No.: 730,996

[22] Filed: May 6, 1985

Related U.S. Application Data

[63] Continuation-in-part of Ser. No. 403,806, Jul. 30, 1982, Pat. No. 4,515,463.

[51] Int. Cl.[4] ..... G03G 15/10

[52] U.S. Cl. ..... 355/10; 355/27; 118/659

[58] Field of Search ..... 355/10, 16, 27; 354/3; 118/659, 662; 430/117–119

[56] References Cited

U.S. PATENT DOCUMENTS

| | | | |
|---|---|---|---|
| 3,839,071 | 10/1974 | Borelli et al. | 430/118 X |
| 4,141,647 | 2/1979 | Lempke et al. | 350/10 |
| 4,383,019 | 5/1983 | Simm | 118/659 X |
| 4,515,463 | 5/1985 | Plumadore | 355/10 |

FOREIGN PATENT DOCUMENTS

| | | | |
|---|---|---|---|
| 2035586 | 6/1980 | United Kingdom | 355/27 |

*Primary Examiner*—A. T. Grimley
*Assistant Examiner*—J. Pendegrass
*Attorney, Agent, or Firm*—Schwartz & Weinrieb

[57] ABSTRACT

A toner flow control system for liquid toner within camera/processor apparatus includes the disposition of a development electrode portion (30, 130, 230) and the electrophotographic film element (14, 114, 214) within planes inclined with respect to a horizontal plane at an angle of between 30° and 60°. A toner flow channel (32, 132, 232) is defined between the development electrode and the film element wherein, as a result of the inclination of the channel, the flow of the liquid toner (36, 136, 236) is able to be controlled and uniformly distributed over the electrode and film element under the influence of gravity. In addition, gravity discharge of the toner is able to be accomplished without any auxiliary devices from the lower free edge portion (46) of the film element (14) when the film element is a roll cassette, while when the film element is an aperture card (114) or a microfiche (214), discharge of the toner from within the vicinity of the lower edge portions (149, 249) of such film element image frames (114, 214) is able to be achieved by means of a passive plate (145, 245) disposed in a non-contact mode with respect to the lower edge portions of the film image frames as a result of surface tension forces developed and defined between the passive plate and the liquid toner.

20 Claims, 3 Drawing Figures

INCLINED TONER FLOW CONTROL SYSTEM FOR DEVELOPING AN ELECTROSTATIC LATENT IMAGE UPON A ROLL CASSETTE, APERTURE CARD, OR MICROFICHE TYPE ELECTROPHOTOGRAPHIC FILM ELEMENT

CROSS-REFERENCE TO RELATED U.S. PATENT APPLICATIONS

This patent application is a continuation-in-part of U.S. pat. application Ser. No. 403,806, entitled INCLINED TONER FLOW CONTROL SYSTEM FOR DEVELOPING AN ELECTROSTATIC LATENT IMAGE UPON AN ELECTROPHOTOGRAPHIC FILM, and filed on July 30, 1982, now U.S. Pat. No. 4,515,463 issued on May 7, 1985.

TECHNICAL FIELD

The present invention relates generally to electrophotography, and more particularly to an improved system of applying liquid developer or toner to a roll cassette, aperture card, or microfiche type electrophotographic film element for developing an electrostatic latent image thereon.

BACKGROUND ART

In electrophotography, a uniform electrostatic charge is initially applied to the surface of a photoconductive layer. This charge is then selectively dissipated in accordance with a particular pattern as determined by exposure of the photoconductive layer surface to a light image. The resulting charge pattern therefore defines an electrostatic latent image upon the photoconductive layer. This latent image may then be rendered visible by applying electostatically charged toner particles to the photoconductive layer, the toner particles adhering to the photoconductive layer surface by means of electrostatic attraction. In turn, the visible image may now be rendered permanent by subjecting the toner particles to a heating process which fuses the particles to the photoconductive layer.

As is well-known, in accordance with the conventionally acceptable developing method utilizing a liquid developer or toner, which comprises a liquid carrier for finely divided electrostatic toner particles, such as, for example, carbon particles, suspended therein, the electrophotographic element or image-exposed film is initially dipped within the liquid toner so as to produce the visible image thereon which of course corresponds to the originally defined latent image. While this development method has of course proven to be quite satisfactory for some types of systems and film, it is simply not feasible or applicable for the specialized type of system in which the imaging and developing are to be automatically accomplished within a single piece of apparatus. A microphotographic copying machine in which data from successive documents is sequentially recorded upon individual frames of a multi-frame microfiche is an exemplary embodiment of the aforenoted specialized type of apparatus.

In addition, in view of the fact that it is desirable to rapidly image and develop each frame prior to, or partially co-extensive with, the processing of the next succeeding frame, the image development process must, of necessity, be one which can be accomplished quickly and conveniently with respect to, for example, a microfiche, strip or roll film, or aperture card, fixed within a suitable holder or support means within the reproduction apparatus. In particular, the developing system must be capable of quickly and accurately applying the correct amount of developer or toner to the imaged area of the electrophotographic film, as well as removing the excess toner from the film without permitting leakage of the toner particles either into the interior portion of the reproduction apparatus, or onto other areas of the film which have already been imaged or have not as yet been imaged. Still further, the development system must be capable of rapidly evaporating or partially drying any portion of the toner carrier liquid remaining upon the film so as to in fact immobilize the toner particles adhering to the film and thereby prevent any smearing of the toned or visible image.

The foregoing characteristics and objectives have been addressed and substantially achieved in a currently commercially available viable record processor apparatus known as the System 200 which is manufactured and distributed by A. B. DICK/SCOTT of South Hadley, Mass. This system is embodied within U.S. Pat. No. 4,141,647 issued to George D. Lempke and Nils L. Hakanson; U.S. Pat. No. 4,047,950 issued to Frank C. Gross; U.S. Pat. No. 3,972,610 issued to Frank C. Gross; U.S. Pat. No. 3,927,639 issued to the present inventor-applicant of this application, John D. Plumadore; and U.S. Pat. No. 3,916,828 issued to Frank C. Gross. All of these patents are concerned, in their entirety, or at least in part, with toner flow control systems wherein, for example, the microfiche, film card, or the like, is disposed within a vertical plane angularly located 90° relative to a horizontal plane. In turn, therefore, when the liquid toner or developer is conducted into fluidic contact with the particular portion of the microfiche or the like being toned or developed, the liquid toner will of necessity be flowing in a vertical plane path.

Thus, while the System 200 comprises viable record processor apparatus, it is apparent that the definition of the toner cell, from the viewpoint of the control of the liquid toner flow characteristics, is necessarily quite complex. Due to the flow of the liquid toner across the face of the photographic element being developed within the vertical plane, as noted hereinbefore, the liquid toner will tend to flow down the full extent of the photographic element or film unless substantial negative pressure or vacuum control means are employed for, in effect, sucking the excess toner off of and away from the film surface. In addition, complex sealing means are often also employed for assuring the appropriate definition of the toner cell. Such sealing means usually comprise components which are movable toward, and retractable away from, the film surface. Such means must be accurately operated and actuated so as not to result in the production of smeared images. Still further, due to the uncontrolled flow of the liquid toner within the vertical plane under the influence of gravity, as well as the vacuum-suction or negative air pressure being impressed upon the liquid toner, nonuniform imaging has also been experienced.

In addition to the aforenoted vertically oriented photographic element systems, and the toner flow control means operatively associated therewith, horizontally disposed photographic element development systems have also been proposed, however, these have proven to be as operationally complex as the vertical systems. As will be readily appreciated, within a system wherein the photographic element being developed is disposed within a horizontal plane while the liquid toner is caused to flow thereover for development of the latent image thereon, there is no natural, that is, gravitational, flow of the toner. Again, therefore, in order to properly control the flow of the liquid toner, substantial pressure differentials must in fact be established. In addition, when liquid toner is caused to flow within a horizontal plane, air bubbles tend to become trapped therein thereby deleteriously affecting the developed image from the viewpoint of image uni- formity.

A need therefore exists for an improved toner flow control system for use in developing an electrostatic latent image upon an electrophotographic film or element whereby the liquid toner flow characteristics or parameters can be easily controlled and the toner cell definition easily achieved.

Accordingly, it is an object of the present invention to provide a new and improved toner flow control system for liquid toner utilized for developing an electrostatic latent image upon an electrophotographic element.

Another object of the present invention is to provide a new and improved toner flow control system for liquid toner utilized in developing an electrostatic latent image upon an electrophotographic element which overcomes the operational disadvantages and drawbacks characteristic of similar conventional toner flow control systems.

Still another object of the present invention is to provide a new and improved toner flow control system for liquid toner utilized in developing an electrostatic latent image upon an electrophotographic element whereby the flow of the liquid toner relative to the portion of the electrophotographic element being developed can be accurately and simply controlled.

Yet another object of the present invention is to provide a new and improved toner flow control system for liquid toner utilized for developing an electrostatic latent image upon an electrophotographic element wherein the flow of the liquid toner relative to the portion of the electrophotographic element being developed can be operationally controlled without the requirement of vacuum suction means or the establishment of substantial differential pressure zones.

Yet still another object of the present invention is to provide a new and improved toner flow control system for liquid toner utilized for developing an electrostatic latent image upon an electrophotographic element wherein the flow of the liquid toner relative to the portion of the electrophotographic element being developed can be operationally controlled such that uniform imaging upon the electrophotographic element portion being developed is achieved.

Still yet another object of the present invention is to provide a new and improved toner flow control system for liquid toner utilized for developing an electrostatic latent image upon an electrophotographic element wherein the flow of the liquid toner relative to the portion of the electrophotographic element being developed can be operationally controlled in such a manner so as to provide sufficient toner cell definition without the requirement of auxiliary complex element-contacting sealing means.

A further object of the present invention is to provide a new and improved toner flow control system for liquid toner utilized for developing an electrostatic latent image upon an electrophotographic element wherein there is provided means for rapidly evaporating residual or excess toner carrier liquid remaining upon the film element after toning has been achieved.

A still further object of the present invention is to provide a new and improved toner flow control system for liquid toner utilized for developing an electrostatic latent image upon an electrophotographic element wherein the aforenoted means for evaporating the residual toner carrier liquid is also provided for seating the element film upon the pressure plate of the support means or holder of the reproduction apparatus as well as for aiding in the toner cell definition.

A yet further object of the present invention is to provide a new and improved toner flow control system for liquid toner utilized for developing an electrostatic latent image upon an electrophotographic element which is substantially simple in design and in its structural components interrelationships so as to render the manufacturing costs of this toner system within the overall camera/processor apparatus relatively low.

A still yet further object of the present invention is to provide a new and improved toner flow control system for liquid toner utilized for developing an electrostatic latent image upon an electrophotographic element wherein the element may be in the form of a roll cassette film, an aperture card having a film medium mounted therewithin, or a microfiche.

DISCLOSURE OF THE INVENTION

The foregoing and other objectives of the present invention are achieved through the provision of a first embodiment of a toner flow control system which is particularly adapted for use with a roll cassette type film element wherein there is provided a development electrode having a portion thereof which is inclined relative to a vertical plane and a horizontal plane such that the electrode portion is disposed at an angle, relative to the horizontal plane, between 10° and 80° , and preferably between 30° and 60° . A glass backing plate, which is an integral or fixed part of the electrophotographic film cassette, for example, when roll film comprises the electrophotographic element upon which the latent image is produced, is also inclined at the same angle as the development electrode so as to be disposed parallel to the development electrode and thereby define therewith a channel within which the film is disposed and through which the liquid toner will flow. In this manner, it is appreciated that the toner flow path will be inclined relative to the horizontal plane at an angle preferably between 30° and 60° . The particular inclined angle can of course be selected so as to optimize the control parameters of the flowing liquid toner.

Toner is provided from a tank or reservoir and is conducted to the film development channel by means of a suitable pump. Due to the angular inclination or disposition of the film element and the toner flow channel defined between the film element and the development electrode, it is appreciated that when the liquid toner flows downwardly over the surface of the film element upon which the latent image has been produced and reaches the lower edge of the film element, gravity will cause the excess toner to be discharged from the film element. A toner shield is provided within the upper region of the film element and in conjunction with the development electrode so as to define the initial portion of the toner flow path.

Positive air pressure, supplied, for example, by means of a low-power fan or blower, completely surrounds the film element within the toner cell. This positive pressure air therefore serves to seat the film against the cassette glass backing or pressure plate as well as to aid in the definition of the side boundaries of the toner cell which are primarily defined by means of the development electrode as a result of the surface tension or capillarity established between the electrode and the toner. During the cyclic termination of the flow of the toner, that is, at the completion of the toning step of the process and prior to the fusing of the image upon the film element, the low pressure air flow also serves to initially dry the visible image upon the film by evaporating the excess toner carrier liquid. The visible image is therefore now in a stable state and ready to be fused at the fusing station of the apparatus.

In accordance with second and third embodiments of the present invention which are particularly applicable for use with aperture card and microfiche type electrophotographic film elements, respectively, in view of the fact that, contrary to the toning and image development process characterizing the film roll cassette of the first embodiment wherein the toner is conducted transversely across the film element and discharged from the lower edge thereof under the influence of gravity, only a predetermined partial portion of the film element is to be toned and developed wherein, in particular, a free lower edge portion of the film element may not be accessible and from which the excess toner may therefore not be readily discharged, there is provided a passive plate or baffle, fabricated from a suitable metal or plastic material, which is disposed within the immediate vicinity of the aperture card or microfiche film element so as to be spaced from the image surface thereof through a distance of only, approximately, 10–15 mils. In this manner, as a result of the surface tension characteristics established or defined between the passive plate or baffle, and the liquid toner, the excess toner will in fact be caused to leave the image surface of the film element and flow downwardly along the passive plate or baffle under the influence of gravity so as to be recirculated back into the toner reservoir or tank.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the different views, and wherein.

BEST MODE FOR CARRYING OUT THE INVENTION

Figure 1:
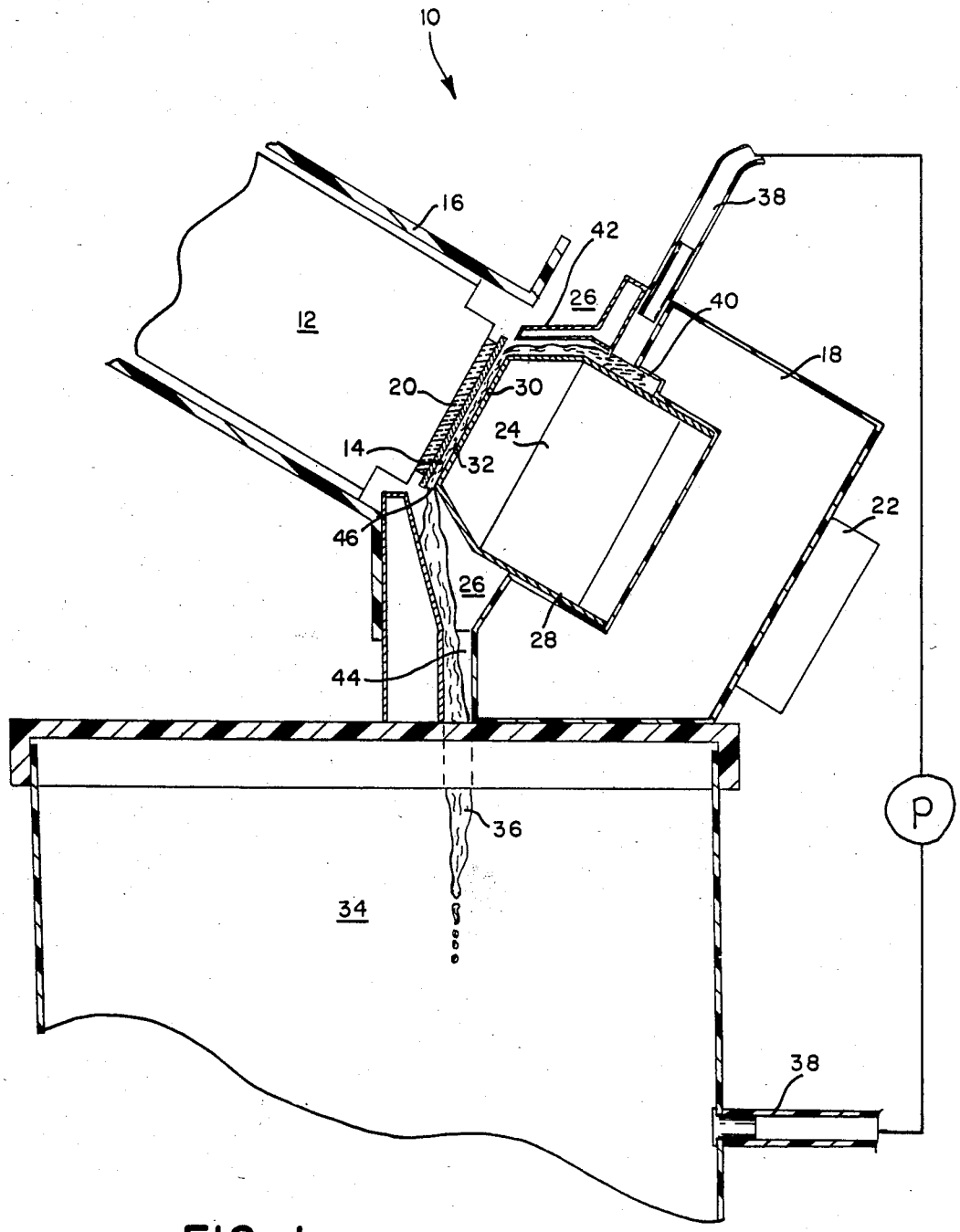
FIG. 1 is a cross-sectional view of a first embodiment of the new and improved toner flow control system constructed in accordance with the present invention and showing the cooperative parts thereof during a toner development portion of the entire image development process which is to be accomplished by the camera/processor apparatus with which the toner flow control system of the present invention is operatively associated, and as applied to a film roll cassette type electrophotographic film element.

Referring now to the drawings, and more particularly to FIG. 1 thereof initially, there is shown a first embodiment of the new and improved toner flow control system of the present invention as applied to the image development of a film roll cassette type electrophotographic film element and as generally designated by the reference character 10. It is to be understood that the toner flow control system 10 of the present invention is to be utilized within camera/processor apparatus for developing an electrostatic latent image upon an electrophotographic element or medium of various different types, such as, for example, a film roll cassette, an aperture card, or a microfiche, however, in accordance with the first embodiment of the present invention, the element or medium comprises a film roll or strip housed within a cassette housing 12. The portion of the film roll or strip which is disclosed as having the latent image produced thereon, and which is adapted to be developed, in part, by the apparatus of the present invention, is designated at 14. It is to be understood further that in connection with the processing of roll or strip film, or microfiche type media microfilm, wherein multiple images are to be developed upon the particular film element in well-known arrays, the toner flow control system of the present invention is to be utilized for the development of any one, or each, of the images of such arrays.

A hollow, cylindrical or annular guide member 16 is mounted upon a base support housing 18 of the camera/processor so as to serve as a mounting or insertion/-withdrawal-facilitating means for the film cassette 12, and it is seen that the cassette 12 is provided at its forward end with a pressure or backing plate 20 against which the film element 14 will be disposed or seated. It is to be further understood that the toner flow control system of the present invention is disposed at a toning station to which the particular film frame being developed at such station has been transported from a charging and exposure station, not shown, although the lens operatively associated with the exposure means of the apparatus at the charging and exposure station is shown at 22, as is part of the corona electrode system 24 which is likewise disposed at the charging and exposure station. In a similar manner, it is also to be appreciated that upon completion of the toning process step of the overall image development process, the toned film portion 14 will be advanced to a fusing station, also not shown, whereby the developed image will be fused to the photoconductive layer of the film 14. Means, not shown, and which may be, for example, a low-power fan or blower, is provided for supplying positive pressure air flow to the three charging and exposure, toning, and fusing stations whereby the film element 14 disposed at the toning stations will be completely surrounded by such positive air pressure, the important reasons for which will become apparent hereinafter. As the film element 14 is also subjected to such positive air pressure at the charging and exposure station, as well as at the toning and fusing stations, it is seen that the film element is always pressed against or seated upon the glass backing or pressure plate 20. In addition, when the film element comprises a microfiche or aperture card, as will be subsequently apparent in connection with this description when reference is made to the second and third embodiments of FIGS. 2 and 3 of the drawings, the positive pressure also facilitates the insertion of the fiche or card into the camera/processor apparatus by causing the fiche or card to be inserted in a "free-floating" mode. This mode also tends to facilitate insertion of the film element without scratching the film surface, as well as to clean the film element with respect to loose dirt or dust particles tending to adhere to the surface thereof. The positive pressure at the toning station which annularly surrounds the film element 14 and the other components of the toner flow control apparatus of the present invention is indicated at 26.

With reference continuing to be made with respect to FIG. 1, it is seen that the toner flow control apparatus of the present invention also includes a development electrode 28 supported within housing 18. The development electrode 28 is uniquely provided with a toner-contacting portion 30 which is inclined relative to a horizontal plane through means of an angle of between 10° and 80°, and preferably of the order of between 30° and 60°. It is seen that the front face of the film backing or pressure plate 20 is similarly inclined so as to be disposed parallel to the inclined portion 30 of the development electrode, and the film element 14, pressed or seated upon the backing or pressure plate 20, is similarly disposed. In this manner, a toner flow control channel 32 is thereby defined between the film element 14 and the development electrode portion 30 so as to also have the requisite degree of inclination.

A toner reservoir or tank 34 is disposed beneath the housing 18, and toner 36 is supplied to the toner flow control channel 32 by means of a conduit 38 and suitable pumping apparatus P. The lower end of conduit 38 is fluidically connected to a toner supply chamber 40 defined within housing 18, and the latter is provided with a rearwardly projecting shield member 42 which serves to define a flow path for, and conduct, the liquid toner 36 into the upper end of the toner flow control channel 32. The lower end of the channel 32 discharges, under the influence of gravity, into a drain channel 44 operatively defined within the lower portion of housing 18 and fluidically connected to the upper portion of reservoir 34. A recirculatory toner flow system is thus defined by means of toner reservoir 34, conduit 38, toner supply chamber 40, toner flow control channel 32, and drain channel 44.

In operation, as will certainly be appreciated, the toner flow control system of the present invention is substantially different from the conventional toner development systems wherein, for example, the toner channel 32 would be disposed within a vertical plane. By the proper selection of the particular angle of inclination of the plane within which toner flow control channel 32 of the present invention is disposed relative to a horizontal plane, the flow speed of the liquid toner is able to be optimally controlled so as to enhance the uniform imaging upon the photographic element 14. This is in fact achieved due to the controlled flow distribution of the liquid toner over the inclined development electrode portion 30 and the inclined element 14. In addition, air bubbles are permitted to escape from the liquid toner in a controlled fashion.

In addition, the system of the present invention uniquely permits the drainage or separation of the excess liquid toner 36 from the bottom edge of the film element, as at 46, under the influence of gravity operating, of course, within a vertical plane, without any requirement for substantial negative pressure or vacuum suction means as is characteristic of the vertically oriented toner flow channels. Similarly, special sealing means, including those of the auxiliary retractable type, for engaging the film element so as to thereby define the toner cell, are also rendered unnecessary. Toner cell definition within the system of the present invention is well defined by means of the upper toner flow control shield 42, and the gravity discharge assistance at 46. The lateral boundaries of the toner cell are primarily defined by means of the lateral extent or dimension of the inclined portion 30 of the development electrode 28, and these lateral boundaries are also aided in their definition by means of the aforenoted annular areas of positive air pressure 26 as well as the provision of such positive air pressure within the exposure and charging station, not shown, disposed toward one side of the toning station, and within the fusing station, also not shown, which is disposed toward the other side of the toning station. Still further, such toner cell definition may be additionally insured by the provision of insulation strips or other similar means within the vicinity of the lateral side edges of the development electrode. By such means, a negative meniscus is impressed upon the liquid toner, which together with the surface tension or capillarity already established between the liquid toner and the development electrode, tends to maintain the toner cell well-defined in its lateral extent.

After the toning step of the development process has been completed, flow of the liquid toner is terminated, and in view of the fact that the entire region annularly surrounding the film element is still continuously subjected to the positive air pressure as at 26, to which region the toner flow control channel 32 is now fluidically connected in view of the absence of toner within channel 32, the air flow within channel 32 serves to initially dry the developed image upon the film element 14 so as to render the image stable. Subsequently, the film element or image frame may be transported to the fusing station wherein the developed image may be permanently fused to the photoconductive layer of the element 14.

Figure 2:
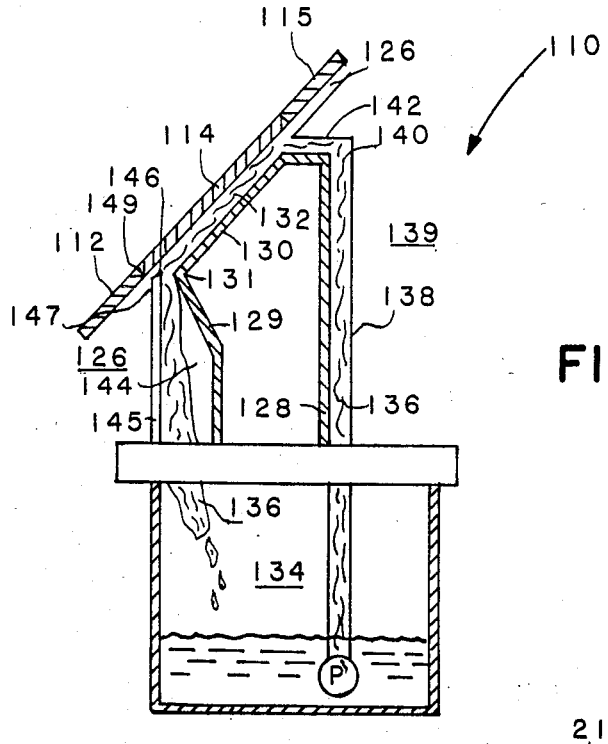
FIG. 2 is a cross-sectional view similar to that of FIG. 1, showing, however, a second embodiment of the new and improved toner flow control system constructed in accordance with the present invention and showing the cooperative parts thereof when the system of the present invention is adapted to be used in conjunction with the image development processing of an aperture card type electrophotographic film element.

With reference now being made to FIG. 2 of the drawings, there is disclosed a second embodiment of the toner flow control system of the present invention as may be applicable for use with an aperture card type electrophotographic film medium which is schematically illustrated at 114. It is noted that like or corresponding parts of the toner flow control system illustrated within FIG. 2, relative to such component parts of the toner flow control system illustrated within FIG. 1, have been given similar reference numerals except that such numerals are now within a "100" series. Continuing further, then, it is seen that the film medium 114 of the aperture card element 112 is mounted within an annular mat 115 so as to comprise a conventional aperture card microfilm element, and the aperture card 112 is of course further adapted to be mounted within suitable transport means, not shown, which will transport the card 112 between the aforenoted exposure and charging, toning, and fusing stations in accordance with the latent image processing of the electrophotographic film media.

As was characteristic of the first embodiment of the present invention as illustrated within FIG. 1, the toning station of the image processing apparatus for use with the processing of an aperture card type electrophotographic film element 112 as is now illustrated within FIG. 2 is seen to similarly comprise, as generally indicated by the reference character 110, a development electrode 128 assembly mounted on top of a liquid toner reservoir or tank 134 into which, and from which, liquid toner 136 is conducted and withdrawn in a recirculatory system aided.in part by means of a suitable pump P' which may, for example, be disposed within the liquid toner reservoir or tank 134 in a submerged state. The pump P' discharges the liquid toner 136 into an upstanding conduit 138 which is defined between the rear side of the development electrode 128 and a toning station housing 139, and the conduit 138 is, in turn, fluidically connected to a substantially horizontally disposed toner supply chamber 140 which is defined between the upper surface of the development electrode 128 and the housing 139, an overhanging portion 142 of housing 139 serving to define a toner shield member.

The aperture card element 112 is disposed within a suitable inclined plane so as to be oriented parallel to the inclined portion 130 of the development electrode 128, and between film medium 114 and the inclined portion 130 of the development electrode 128, there is defined a toner flow control channel 132 which is fluidically connected with toner supply chamber 140. Consequently, as may readily be appreciated, liquid toner 136 is recirculated through the toning station by means of pump P' discharging the toner 136 into upstanding conduit 138 and supply chamber 140, whereupon the same flows downwardly through control channel 132 so as to be in contact with both the inclined portion 130 of the development electrode 128 and the film medium 114. Due to the particular configuration of the development electrode 128, specifically a rearwardly inclined portion 129 thereof which serves to define, along with inclined portion 130 of electrode 128, the lower free edge of inclined electrode portion 130, toner 136 will tend to drip off and be discharged from, under the influence of gravity acting in a vertical plane, the lower free edge or corner section 131 of electrode 128 so as to enter a drain channel 144 which is fluidically connected to toner reservoir or tank 134.

While it is therefore appreciated that excess toner discharge into drain channel 144 is efficiently effected upon the development electrode side of control channel 132 due to the provision of the lower free edge corner section 131 of electrode 128, and the inclination of electrode portion 130 from which the excess toner may be discharged, at corner section 131, under the influence of gravity acting within the vertical plane, such is not readily the case with respect to such excess toner 136 upon the film medium side of flow control channel 132 in view of the fact that, contrary to the embodiment of FIG. 1 wherein the film medium 14 comprised a film roll cassette having a lower free edge portion from which excess toner could in fact drip off or be discharged under the influence of gravitational forces, film medium 114 does not have a lower free edge portion. To the contrary, film medium 114 is surrounded by means of a mat or framework 112 onto the lower portion thereof the aforenoted excess toner would tend to be conducted under surface tension forces established by means of the film medium 114 and mat 112 with respect to the toner 136.

Consequently, in order to eradicate the foregoing defilement of the film element mat or framework 112, there is provided in accordance with this second embodiment of the present invention an upstanding passive plate or baffle 145 which is disposed atop the toner reservoir or tank 134 such that the upper free edge portion 147 of the passive plate or baffle 145 is disposed within the immediate vicinity of the lower edge portion 149 of the image frame defined within the aperture card film medium 114. In particular, the upper free edge portion 147 of the passive plate or baffle 145 is separated from the surface of the lower edge portion 149 of film medium 114 by means of a distance of approximately 10–15 mils or approximately $\frac{1}{3}$ of a millimeter. In this manner, as a result of the baffle or plate 145 being disposed in a non-contact mode with respect to the film medium 114, smearing of the toner 136 upon the film medium, or other deleterious effects upon the developed film medium image, as would be encountered if the baffle or plate 145 was disposed in contact with the surface of the film medium 114, such as, for example, scratching or scarring of the film medium surface, is effectively prevented. Alternatively, the disposition of the plate or baffle 145 within the aforenoted immediate vicinity of the film medium surface portion 149 serves to establish desired surface tension characteristics between the passive plate or baffle 145 and the liquid toner 136 such that the latter, flowing downwardly through the flow control channel 132, and upon encountering the upper free edge portion 147 of the baffle or plate 145, will readily flow downwardly along the interior surface of baffle or plate 145, as disposed within drain channel 144, for recirculatory deposit back within the reservoir or tank 134, without continuing to proceed further downwardly along or upon aperture card element 112 so as to thereby be prevented from encountering the aperture card element annular mat or frame 115. The thickness of passive plate or baffle 145 may be approximately 10–30 mils, and it is to be emphasized at this junction that what is meant by means of the term "passive" is that such is to be distinguished from an "active" system wherein, for example, movement or moving components would be required, such as, for example, within high-vacuum suction systems which would ordinarily be required in order to achieve discharge or withdrawal of the excess toner from the film medium surface, or still yet further, movable seal systems which require seal means to be forcefully disposed into surface contact with the film medium surface in order to effectively prevent continued flow of the excess toner downwardly along the film medium surface beyond the boundary of the image frame being developed. To the contrary, with the passive baffle or plate means of the present invention, provision of moving components, or the provision of means for developing high, negative-pressure fluid flow systems, is eliminated while nevertheless permitting or facilitating the effective discharge or withdrawal of excess toner fluid 136 from the surface of the film medium 114, under the influence of gravitational forces acting within a vertical plane, as indicated at 146, all in a manner similar to that characteristic of the cassette roll film disclosed within the embodiment of FIG. 1. It is to be emphasized still further that while various other factors characteristic of the present invention indeed aid in the desired discharge or withdrawal of the excess toner 136 from the film medium surface region 149 at the denoted point of discharge 146, such as, for example, the positive air pressure plenum 126 surrounding the toner station, or the image frame region pre-determinedly defined, in effect, by means of the charge pattern initially impressed upon the film medium at the exposure/charge station, and to which charge pattern the liquid toner is naturally attracted in accordance with well-known electrophotographic principles, the disposition or provision of the passive baffle or plate 145 in accordance with the present invention is in fact the critical factor which renders the apparatus embodiment disclosed within FIG. 2 to be effectively operative and commercially feasible.

Figure 3:
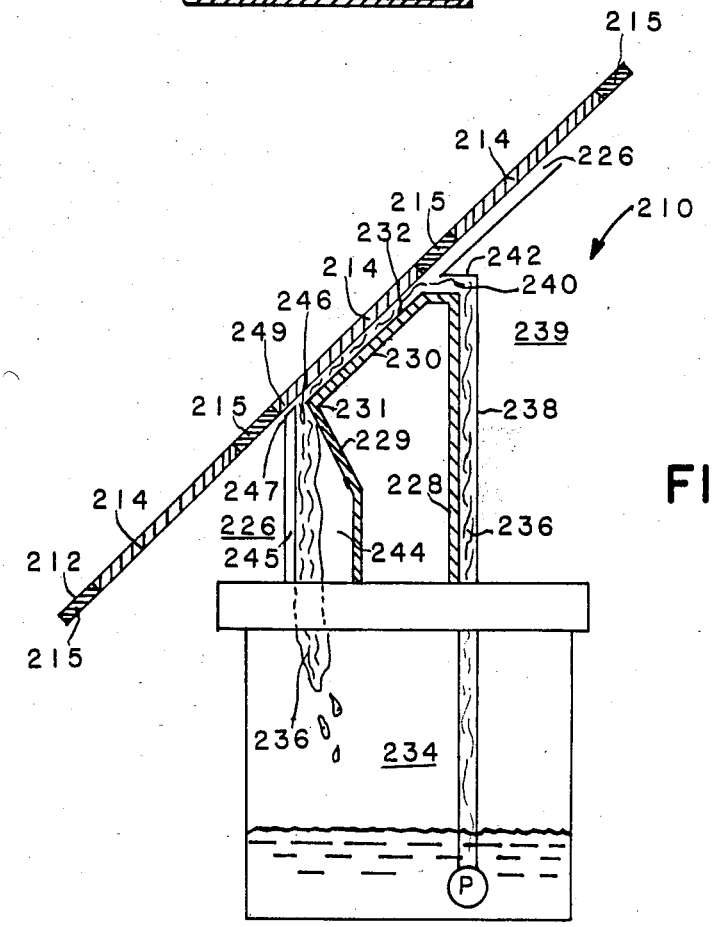
FIG. 3 is a cross-sectional view similar to that of FIGS. 1 and 2, showing, however, a third embodiment of the new and improved toner flow control system constructed in accordance with the present invention and showing the cooperative parts thereof when the system of the present invention is adapted to be used in conjunction with the image development processing of a microfiche type electrophotographic film element.

With reference now being made to FIG. 3 of the drawings, there is disclosed a third embodiment of the present invention which is generally designated by the reference character 210, and it is noted at this point that like or corresponding component parts, relative to those disclosed in connection with the embodiments of FIGS. 1 and 2, have been given the same reference character numbers except that those in connection with the third embodiment of FIG. 3 are denoted as being in the "200" series. The embodiment of FIG. 3 is adapted to be used in conjunction with the image development of a microfiche type electrophotographic microfilm element 212 which is seen to comprise an array of image frames 214 arranged in rows and columns as is conventional, with the image frame areas 214 separated by non-image regions 215. The microfiche element 212 is adapted to be supported by means of a suitable X-Y transport system, not shown, which is capable of moving the element 212 in both the X and Y directions as also conventional so as to position any particular one of the image frames 214 at a particular processing station, such as, for example, the charge/exposure station, the toning station, and the fusing station. In FIG. 3, a particular image frame 214 disposed within the central horizontally extending row of the microfiche element 212 is shown disposed opposite the inclined portion 230 of the development electrode 228 at the toning station so as to be able to have its latent image developed in accordance with the techniques described hereinbefore. As was the case with the aperture card film element 112 of the second embodiment illustrated within FIG. 2, there is provided a passive plate or baffle means 245 which is disposed within the immediate vicinity of the toned surface of the microfiche element 212 such that proper toning development of, for example, the central image frame 214 disposed opposite the inclined development electrode portion 230 can be achieved without excess toner 236 continuing to flow downwardly along the surface of the film element 212 whereby such excess liquid toner 236 might otherwise affect the toning, development, and image projection properties and quality of, for example, the lowermost image frame 214 disposed beneath the central image frame 214 being presently processed.

Thus, it may be seen that the present invention is uniquely capable of controlling the flow of liquid toner during the processing of electrophotographic microfilm elements regardless of whether the element comprises a film roll cassette, an aperture card, or a microfiche, without the requirement of substantial differential pressure or vacuum suction means, toner cell definition seal devices, or the like, and in the particular instance of aperture card and microfiche type film elements, the aforenoted processing of the latent images upon the film elements is achieved without deleteriously affecting the surrounding mat or frame of the aperture card, or other image frames of the microfiche.

Obviously, many modifications and variations of the present invention are possible in light of the above teachings. It is therefore to be understood that within the scope of the appended claims, the present invention may be practiced otherwise than as specifically described herein.

I claim:

1. A toner flow control system for developing an electrostatic latent image upon a predetermined partial portion of an electrophotographic film element, comprising:

a developing electrode;

an electrophotographic film element disposed parallel to, yet spaced from, said development electrode so as to define therewith a channel therebetween;

means defining an electrostatic latent image frame upon said predetermined partial portion of said electrophotographic film element, including upper, lower, and side edge image frame portions, such that said electrostatic latent image faces said development electrode;

means for introducing toner into said channel such that said toner flows across said electrostatic latent image frame from within the vicinity of said upper edge portion of said image frame to within the vicinity of said lower edge portion of said image frame for development of said electrostatic latent image upon said predetermined partial portion of said electrophotographic film element;

said development electrode, said electrophotographic film element, and said toner channel being disposed within planes inclined with respect to a horizontal plane such that said toner may flow through said channel, and over the facing surfaces of said predetermined partial portion of said film element and said development electrode, in a controlled manner under the influence of gravitational forces; and passive means disposed in a non-contact mode within the vicinity of said lower edge portion of said image frame for cooperating with said toner, flowing over said facing surface of said predetermined partial portion of said film element and within said vicinity of said lower edge portion of said image frame, in the establishment of attractive forces defined between said passive means and said toner so as to facilitate the discharge of said toner from said electrophotographic film element within a substantially vertical plane under the influence of said gravitational forces such that said toner does not deleteriously affect the remaining portion of said electrophotographic film element outside of said predetermined partial portion of said electrophotographic film element upon which said image frame is defined.

2. A system as set forth in claim 1, wherein:

said electrophotographic film element comprises an aperture card.

3. A system as set forth in claim 1, wherein:

said electrophotographic film element comprises a microfiche.

4. A system as set forth in claim 1, wherein:

said passive means comprises a vertically oriented plate.

5. A system as set forth in claim 4, wherein:

said passive plate means is spaced from the surface of said electrophotographic film element by means of a distance within the range of 10-15 mils.

6. A system as set forth in claim 4, wherein:

said passive plate means has a thickness within the range of 10-30 mils.

7. A system as set forth in claim 1, wherein:

said means for introducing said toner into said channel comprises a recirculatory pumping system.

8. A system as set forth in claim 4, wherein:

said plate is fabricated from metal.

9. A system as set forth in claim 4, wherein:

said plate is fabricated from plastic.

10. A system as set forth in claim 1, wherein:

said angle of inclination of said electrode, film element, and said toner channel is within the range of 30° -60° .

11. A system as set forth in claim 1, wherein:

said electrophotographic film element is disposed in a stationary mode relative to said development electrode when said toner is introduced into said channel.

12. A system as set forth in claim 1, wherein:

said development electrode is disposed below said electrophotographic film element within said parallel planes.

13. A system as set forth in claim 1, wherein:

said inclination of said electrophotographic film element is such that said toner is discharged from said vicinity of said lower edge portion of said image frame and within said vertical plane in a direction away from the surface of said film element upon which said image frame is defined and away from the non-imaged surface of said electrophotographic film element.

14. A system as set forth in claim 1, further comprising:

a reservoir tank for collecting said toner discharged from within the vicinity of said lower edge portion of said image frame.

15. A system as set forth in claim 14, wherein:

said passive means is disposed atop said reservoir tank.

16. A system as set forth in claim 2, wherein:

said predetermined partial portion of said electrophotographic film element comprises film medium; and said remaining portion of said electrophotographic film element comprises an annular mat frame disposed about said film medium.

17. set forth in claim 3, wherein:

said predetermined partial portion of said electrophotographic film element comprises a single image frame of said microfiche; and said remaining portion of said electrophotographic film element comprises previously developed image frames of said microfiche.

18. A system as set forth in claim 3, wherein:

said predetermined partial portion of said electrophotographic film element comprises a single image frame of said microfiche; and said remaining portion of said electrophotographic film element comprises non-imaged film medium upon which images may subsequently be developed.

19. A toner flow control system for developing an electrostatic latent image upon a predetermined partial portion of an electrophotographic film element, comprising:

a development electrode;

an electrophotographic film element disposed parallel to, yet spaced from, said development electrode so as to define therewith a channel therebetween;

means defining an electrostatic latent image frame upon said predetermined partial portion of said electrophotographic film element, including upper, lower, and side edge image frame portions, such that said electostatic latent image faces said development electrode;

means for introducing toner into said channel such that said toner flows across said electrostatic latent image frame from within the vicinity of said upper edge portion of said image frame to within the vicinity of said lower edge portion of said image frame for development of said electrostatic latent image upon said predetermined partial portion of said electrophotographic film element;

said development electrode, said electrophotographic film element, and said toner channel being disposed within planes inclined with respect to a horizontal plane such that said toner may flow through said channel, and over the facing surfaces of said predetermined partial portion of said film element and said development electrode, in a controlled manner under the influence of gravitational forces; and passive means disposed within the vicinity of, yet spaced from, said lower edge portion of said image frame for facilitating the discharge of said toner from said electrophotographic film element within a substantially vertical plane under the influence of said gravitational forces and as a result of surface tension forces defined between said passive means and said toner, such that said toner does not deleteriously affect the remaining portion of said electrophotographic film element outside of said predetermined partial portion of said electrophotographic film element upon which said image frame is defined.

20. A toner flow control system for developing an electrostatic latent image upon a predetermined partial portion of an electrophotographic film element, comprising:

a development electrode;

an electrophotographic film element disposed parallel to, yet spaced from, said development electrode so as to define therewith a channel therebetween;

means defining an electrostatic latent image frame upon said predetermined partial portion of said electrophotographic film element, including upper, lower, and side edge image frame portions, such that said electrostatic latent image faces said development electrode;

means for introducing toner into said channel such that said toner flows across said electrostatic latent image frame from within the vicinity of said upper edge portion of said image frame to within the vicinity of said lower edge portion of said image frame for development of said electrostatic latent image upon said predetermined partial portion of said electrophotographic film element;

said development electrode, said electrophotographic film element, and said toner channel being disposed within planes inclined with respect to a horizontal plane such that said toner may flow through said channel, and over the facing surfaces of said predetermined partial portion of said film element and said development electrode, in a controlled manner under the influence of gravitational forces; and passive plate means disposed in a non-contact mode within the vicinity of, and with respect to, said lower edge portion of said image frame for facilitating the discharge of said toner from said electrophotographic film element within a substantially vertical plane under the influence of said gravitational forces and as a result of surface tension forces defined between said passive plate means and said toner, such that said toner does not deleteriously affect the remaining portion of said electrophotographic film element outside of said predetermined partial portion of said electrophotographic film element upon which said image frame is defined.

* * * * *